US005486030A

United States Patent [19]

Cobelo

[11] Patent Number: 5,486,030

[45] Date of Patent: Jan. 23, 1996

[54] APPARATUS AND METHOD FOR LIFTING AND DEPOSITING BOTTLES HAVING HANDLES

[75] Inventor: Vincent Cobelo, Oldsmar, Fla.

[73] Assignee: ABC Packaging Machine Corporation, Tarpon Springs, Fla.

[21] Appl. No.: 238,219

[22] Filed: May 4, 1994

[51] Int. Cl.[6] ..... B66C 1/66

[52] U.S. Cl. ..... 294/113; 294/88; 294/110.1

[58] Field of Search ..... 294/28, 87.22, 294/87.24, 88, 90, 110.1, 113, 115, 158, 86.4

[56] References Cited

U.S. PATENT DOCUMENTS

| | | | |
|---|---|---|---|
| 1,766,549 | 6/1930 | Schroder . | |
| 2,619,373 | 11/1952 | Stewart | 294/113 X |
| 2,679,328 | 5/1954 | Ballato et al. | 214/309 |
| 2,730,279 | 1/1956 | Enock | 226/14 |
| 3,108,835 | 10/1963 | Rowekamp | 294/88 |
| 3,125,369 | 3/1964 | Copping | 294/87.24 |
| 3,174,791 | 3/1965 | Dardaine | 294/87.24 |
| 3,285,650 | 11/1966 | Dukes | 294/110.1 X |
| 3,600,031 | 8/1971 | Coleman et al. | 294/110.1 X |
| 3,604,742 | 9/1971 | Sprague | 294/33 |
| 3,625,558 | 12/1971 | Johnson | 294/110.1 X |
| 3,901,547 | 8/1975 | Skinner, II | 294/115 X |
| 3,934,920 | 1/1976 | Rowekamp | 294/87 R |
| 3,938,847 | 2/1976 | Peyton | 294/110 R |
| 3,945,676 | 3/1976 | Asamoto | 294/88 |
| 3,948,552 | 4/1976 | Hamrick | 294/115 |
| 4,262,795 | 4/1981 | Hecker | 198/479 |
| 4,348,044 | 9/1982 | Wood, III | 294/88 |
| 4,351,553 | 9/1982 | Rovetta et al. | 294/106 |
| 4,368,913 | 1/1983 | Brockmann et al. | 294/106 |
| 4,395,069 | 7/1983 | Lebret | 294/87.22 |
| 4,452,479 | 6/1984 | Terai et al. | 294/88 |
| 4,460,212 | 7/1984 | Montferme | 294/115 |
| 4,529,432 | 7/1985 | Nebelung et al. | 65/260 |
| 4,537,557 | 8/1985 | Whitney | 414/735 |
| 4,592,581 | 6/1986 | Howard et al. | 294/2 |
| 4,645,407 | 2/1987 | Williams | 414/730 |
| 4,781,408 | 11/1988 | Hernandez | 294/99 |
| 4,850,631 | 7/1989 | Dotsko | 294/86.4 |
| 4,941,699 | 7/1990 | Wilfong | 294/99 |
| 5,052,736 | 10/1991 | Loncaric et al. | 294/106 |

*Primary Examiner*—Dean Kramer
*Attorney, Agent, or Firm*—Hopkins & Thomas

[57] ABSTRACT

An apparatus and method for lifting and transporting a bottle by its handle from one surface to a second surface and for releasing the bottle at the second surface, the apparatus having a frame with four inwardly converging fingers, pivotally mounted to a frame. Spring loaded control rods hold the fingers in horizontal positions so that the distal ends of the fingers terminate adjacent to each other. The frame is moved downwardly over the bottle so that the distal ends of the fingers pass around the handle and then support the bottle by the handle as the frame lifts and transports the bottle from one surface to another. The rods are pneumatically released when the frame is to move away from the bottle, thereby enabling the fingers to release the handle of the bottle. In different orientations of the bottle, less than all of the fingers protrude beneath the handles for raising and transporting the bottle.

33 Claims, 2 Drawing Sheets

APPARATUS AND METHOD FOR LIFTING AND DEPOSITING BOTTLES HAVING HANDLES

FIELD OF INVENTION

This invention relates to an apparatus and method for lifting and depositing bottles having handles. More particularly, this invention relates to an apparatus and method for lifting, conveying and depositing containers by their handles to and from prescribed locations.

BACKGROUND OF THE INVENTION

In the past, a number of prior art devices have been devised for lifting and depositing bottles by the neck or cap of the bottle, even though the bottle to be lifted may have had a handle built into the bottle. Although this has proven to be an acceptable method for handling bottles, it presents the inherent problem that if there is a structural fault in the bottle neck or cap, or if the cap has not been adequately tightened upon the bottle, the bottle can slip and fall out of the handling device.

An example of a handling device which carries a bottle by its cap is disclosed in U.S. Pat. No. 3,604,742, issued Sep. 14, 1971, to Sprague. Sprague disclosed an apparatus for automatically lifting and handling objects having off-center neck portions, such as bottles or other containers, supporting them frictionally by the cap of the bottle. This was accomplished in Sprague through an apparatus having an annular ridge and a plate member which descends upon the bottle or object to be carried, and is moved in a orbital path yieldably passing over the cap of the bottle until it frictionally engages and lifts the bottle, solely by its cap. The bottle is then moved to another location, or placed into a packing box. At the time the bottle is to be released, a plunger mechanism releases the ridge and plate member by which Sprague frictionally held and carried the bottle.

The present invention does away with the necessity of frictionally engaging and carrying a bottle by its off-center neck portion. This invention includes a method and apparatus by which a bottle with an off-center neck portion and a handle is positively engaged and carried by its handle for providing a more efficient, less hazardous, and economical method for lifting or depositing a bottle to or from a platform or packing box.

SUMMARY OF THE INVENTION

Briefly described, the present invention includes a lifting assembly which has a movable support frame, for being initially positioned over the bottle upon the platform. A plurality of guide rods, extending downwardly from a plate of the support frame, align the support frame with the bottle as the support frame is lowered toward the bottle. A plurality of circumferentially spaced, opposed, inwardly extending, handle engaging fingers, respectively pivotally connected to the support frame, converging toward each other so as to pivot upwardly and around the handle, as the frame descends and then pivot toward each other to horizontal positions for carrying the bottle by its handle.

The invention is also provided with adjustable control rods respectively engaging the fingers for permitting each of the fingers to pivot independently upwardly as the fingers pass downwardly around opposite portions of the transverse portions of the bottle handle, while permitting those fingers, the ends of which pass around the handle, to return to their normal positions for lifting the bottle off of the platform as the support frame is raised. Each of the control rods is spring loaded downwardly to permit the fingers to pivot downwardly for releasing the transverse portion of the bottle handle, once a control plate is actuated so that the support frame may then be moved away from the bottle, leaving the bottle in its new position. Thereafter, each of the handle engaging fingers, in conjunction with the control rods and the movable support frame, are returned to their normal positions so that the bottle lifting apparatus can be used for lifting and depositing another bottle.

Accordingly, it is an object of the present invention to provide,an apparatus for transporting bottles, having off-center necks, which will positively support and move them from one place to another.

Another object of the invention is to provide an apparatus and method for automating transporting bottles in packing boxes or for unloading bottles from packing boxes.

It is another object of the invention to provide an apparatus for lifting and depositing bottles which is adaptable for use in commercial applications involving the automatic handling and shipping of bottles, with off-center necks and carrying handles, so that the need for manual labor in handling, transporting and packing the bottles is reduced.

A further object of the invention is to provide an apparatus for lifting and depositing the bottles by their handles which can be quickly, simply and inexpensively installed in industrial or commercial applications, or can be easily and inexpensively retrofitted to existing bottle handling and packaging machines.

Another object of the invention is to provide an apparatus for lifting and depositing bottles which can lift and move upright bottles, having off-center necks and carrying handles regardless of the angular orientation of the handles of the bottles.

Still another object of the present invention is to provide an apparatus and method for transporting containers having handles which apparatus is inexpensive to manufacture, simple and durable in structure, efficient in operation, and requires little maintenance.

Other objects, features and advantages of the present invention will become apparent from the following description when considered in conjunction with the accompanying drawings wherein like characters of reference designate corresponding parts throughout the several views.

DETAILED DESCRIPTION OF THE DRAWINGS

DETAILED DESCRIPTION

Figure 1:
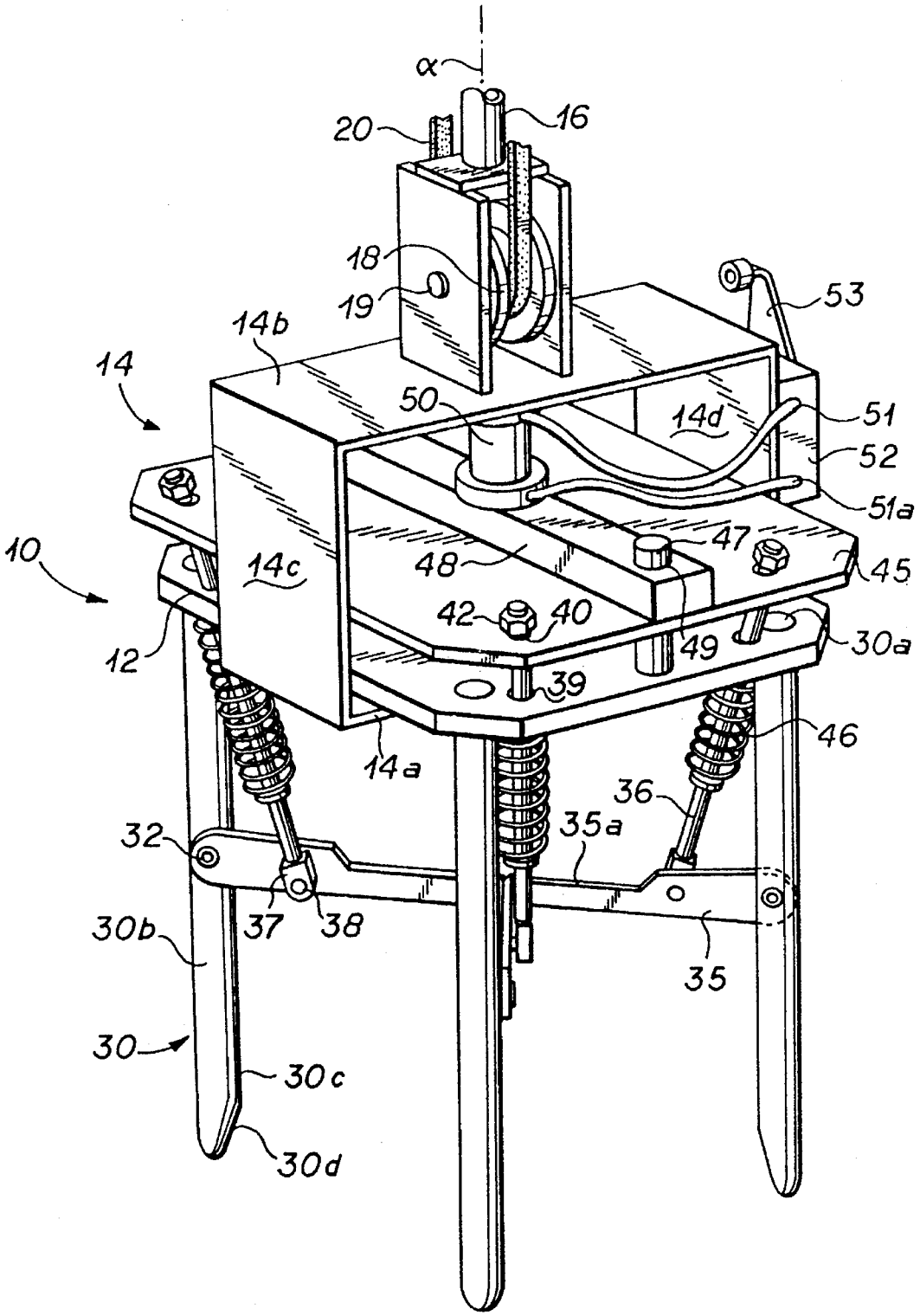
FIG. 1 is a perspective view of an apparatus for lifting and depositing bottles having handles, constructed in accordance with the present invention.
Figure 2:
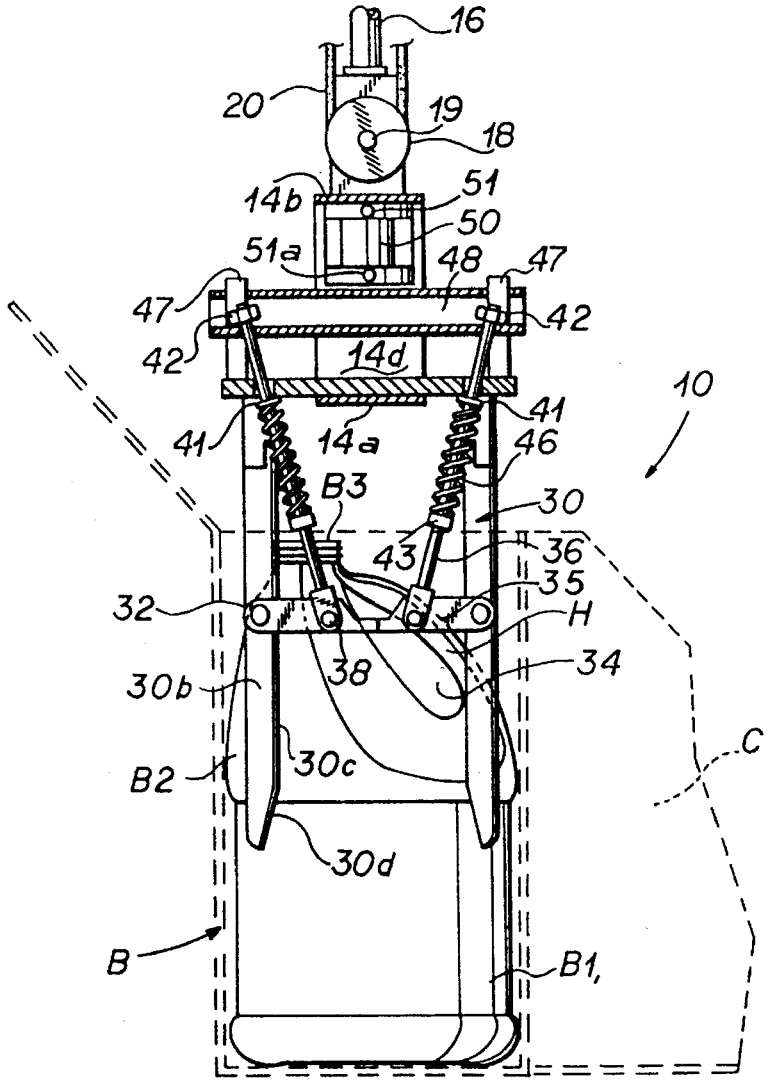
FIG. 2 is a side elevational view, partially in cross section, showing the apparatus for lifting and depositing bottles shown in FIG. 1 and in operative relationship to a bottle having a laterally extending handle, the box for the bottles being depicted in broken lines.

Referring now in detail to the embodiment chosen for purposes of illustrating the invention, numeral 10 in FIG. 1 denotes, generally, a movable support frame or frame assembly having a flat, rigid, horizontally disposed, rectangular or square base plate 12. An open, rectangular support strap or frame 14 of the frame assembly 10 encompasses the central portion of the base plate 12, the support strap 14 having a pair of horizontally disposed, opposed, complimentary, rectangular, lower and upper panels 14*a* and 14*b*, the ends of which are joined by opposed, vertically disposed, end panels 14*c* and 14*d*.

Lower panel 14*a* passes transversely beneath and is fixed to the central portion of base plate 12 so that the ends of the base plate 12 protrude in opposite directions beyond the side edges of panels 14*a* and 14*b*.

For lifting and lowering the frame assembly 10, so as to transport the bottle B, from one place to another, a conventional bottle transfer machine is used, the machine including an upright, telescoping, hollow tubular, rectangular transport standard or shaft 16. The lower end of shaft 16 is secured to the central upper surface of panel 14*b*.

The lower portion of transportation shaft 16, is provided with an idler sheave or pulley 18 rotatably mounted on a transverse shaft 19 within the shaft 16. A belt 20 passes around the lower portion of pulley 18 and thence upwardly on both sides of shaft 16. By taking in one end of the belt 20, the frame or frame assembly 10 is lifted, vertically and by releasing or paying out the belt 20, the frame assembly 10 is lowered.

The shaft 16 is moved laterally to move the frame assembly 10 from one location to another in a conventional manner, by manipulation of shaft 16, so that bottle B can be moved from a first surface, such as a conveyor belt or platform (not shown) and deposited on a second surface, such as the bottom of a crate, or box C, shown in broken lines in FIGS. 2, 3A, 3B and 3C.

Frame 10 includes guide rods 30 protruding downwardly from the corners of the rectangular or square base plate 12. Usually a plurality of four, equally spaced generally parallel, vertically disposed, guide rods 30 are provided. The rods 30 are each flat, straight, steel ribs, the upper or proximal end portions of which are rounded, forming solid cylindrical mounting lugs 30*a* which are respectively press fitted and fixed within holes in the corner portions of base plate 12. The guide rods 30 are evenly spaced, circumferentially around the vertical axis α of the frame assembly 10, the body 30*b* of each rod 30, below the lug 30*a*, being rectangular in cross-section so that the bodies 30*b* lie generally in radial planes with respect to axis α.

In FIG. 1, it is seen that the straight inner edge portions 30*c* of rods 30 function as guide edges which pass along the surfaces of the respective side portions of bottle B as the frame assembly 10 is lowered so as to orient the frame assembly 10 over the bottle B. To facilitate the orientation, the lower or distal inner end portions of the rods 30 are provided with outwardly and downwardly diverging cam surfaces or edges 30*d*.

Intermediate the ends of rods 30 are sidewise protruding pivot pins 32, which respectively pivotally receive and support the proximal end portions of lifting fingers or grippers 35. Each finger 35 is disposed by its proximal end position along one side of its guide rod 30 so that it normally protrudes inwardly from its associated pivot pin 32 to terminate adjacent to axis α. Each lifting finger 35 is a flat straight rod which is rectangular in cross-section, each finger 35 being formed from a straight flat piece of sheet metal, having relatively wide proximal and central portions, which is narrowed toward its tip or distal end portion to provide a straight, upper edge or surface 35*a*. The function of these lifting fingers or grippers 35 is to cooperate in passing around a lateral portion of handle H at the upper position of the bottle B and then support the bottle B by its handle H as the bottle B is lifted and lowered.

In the present embodiment the lifting fingers 35 are arranged 90° from each other and protrude generally radially inwardly; however, since the fingers 35 are pivoted at the sides of the guide rods 30, the ends of diametrically opposed fingers 35 terminate in slightly offset relationship essentially parallel to each other. The fingers 35 terminate with their inner or distal ends adjacent to axis α.

The fingers 35 are disposed normally in a common horizontal plane and can individually pivot in an arcuate path upwardly or downwardly.

For supporting the fingers 35 in their generally horizontal converging positions, and manipulating the fingers 35, a plurality of individual, straight, rigid, control rods 36 are respectively provided for the lifting fingers 35. Each control rod 36 is provided at its lower end, with a pivot block 37 which receives a transverse pivot pin 38. The pivot pins 38 are respectively parallel to the pivot pins 32 and pass through intermediate portions of the lifting fingers 35. Pins 38 pivotally connect the end of rods 36 to the lifting fingers 35 so that each rod 36, respectively, supports fingers 35 for limited pivotal movement of lifting fingers 35 about pins 32.

Rods 36 extend upwardly and outwardly, passing through holes 39 in the corner portions of the base plate 12 and thence upwardly through holes 40 in a control or actuator plate 45 disposed in parallel relationship normally spaced above plate 12 so that the rods 36 can move axially upwardly and downwardly with the fingers 35.

Helical compression springs 46 respectively coaxially encompass the upper portions of rods 36, below the base plate 12, each rod 6 having a collar or sleeve 43 adjustably fixed to an intermediate portion of the rod 36 and against which the spring 46 reacts. The upper end of each spring 46 abuts a washer 41 below base plate 12 and slideably on rod 36.

All rods 36 terminate above the actuator plate 45, the upper end portions of rod 36 having external threads which threadedly receive nuts 42. Nuts 42 form stops which limit the downward movement of rods 36 and are adjustable to ensure that all fingers 35 are normally in horizontal positions.

The plate 45 is a flat horizontally disposed member which is generally rectangular, i.e., square, and conforms to the shape of base plate 12. Actuator plate 45 is reinforced by central, transversely extending, inverted, U-shaped, channel or rib 48 which extends radially along the central upper surface of plate 45, from one side to the other. Upstanding parallel guide shafts 47, mounted by their proximal ends respectively adjacent to opposite edges on base plate 12, pass through alignment holes in actuator plate 45 and through holes 49 in the top of rib 46, the guide shafts 47 thus guide the plate 45 upwardly and downwardly toward and away from base plate 12.

For controlling the movement of the actuator plate 45, the plate 45 is suspended by an actuator means such as a central piston rod (not shown) carried by a vertically disposed, double acting, pneumatic (fluid operated) cylinder 50 mounted along axis α on the lower side of the upper panel 14*b*. Fluid, preferably compressed air, is supplied to cylinder 50, via air lines or tubes 51 and valve 52, mounted on the outside surface of the upright end panel 14*d*. An upstanding spring loaded lever 53 operates valve 52.

Operation

From the foregoing description, the operation of the present invention should be apparent. The frame or frame assembly 10 for lifting and depositing successive bottles B can either be operated to install bottles B in a container or crate C or remove the bottles B from that crate, as desired. In its usual use, the apparatus is employed for picking up successive bottles B from a conveyor and placing those bottles in one or several containers C on another conveyor.

The bottle B is usually prefilled with a liquid and has a cylindrical body $B_1$, provided with a neck $B_2$, and a cap $B_3$ and a bottom $B_4$. The neck $B_2$ is offset from the centerline or axis $\alpha$ of the bottle B and a handle H extends laterally from the upper portion of the neck $B_2$, across axis $\alpha$ of the body $B_1$ of the bottle B and, thence, downwardly to connect integrally with the body $B_1$, adjacent to the periphery of body $B_1$. This handle H therefore, has a transverse portion which defines, with the bottle B, an opening $B_5$ through which a person's fingers may pass when the person grasps the bottle B. Thus, the opening $B_5$ has a transverse component and is sufficiently long and wide that it will receive the hand of a person who is lifting the bottle B. Fingers 35 of the apparatus also lift the bottle B by means of the handle H.

The apparatus is lowered onto the bottle B either while the bottle B is stationery on its initial surface or while both the bottle B and frame assembly 10 are moving in the same direction and at the same speed. In any event, the frame assembly 10, after being positioned over bottle B by the telescoping shaft 16, is progressively lowered onto the bottle B so that the guide bars 30 move down around sides of the body $B_1$ by shaft 16 of bottle B, thereby aligning frame 10 and bottle B along axis $\alpha$. As the frame 10 is lowered, the lower surfaces of two or more of the distal ends of fingers 35, engage the upper surface of the handle H of bottle B on a first surface, so that, upon further movement of the frame 10 in a downward direction, the distal ends of fingers 35 are progressively moved upwardly in arcuate paths about the pivot pins 32. The fingers 35, therefore, move upwardly with respect to bottle B and outwardly with respect to axis thereby moving the yieldable control rods 36 along their respective axis upwardly through the holes or slots in plates 12 and 45. After the fingers 35 have passed the handle H, they are returned to their horizontal positions by the force of springs 46.

Figure 3A:
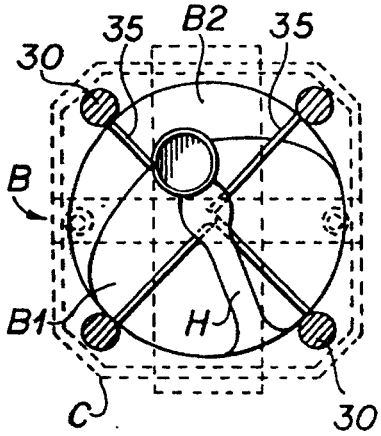
FIG. 3A is a schematic top plan view of a bottle with an off center-neck and a handle and showing the handle engaging fingers of the apparatus of FIG. 1 engaged under the handle of the bottle, the bottle being in a first orientation and being received in a box shown in broken lines.
Figure 3B:
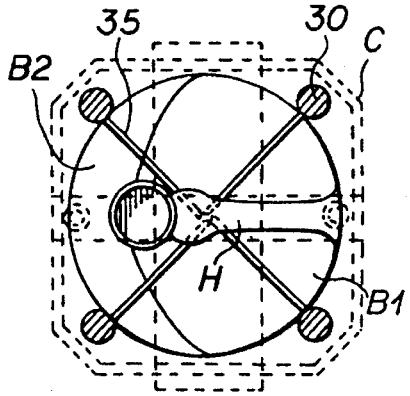
FIG. 3B is a schematic top plan view similar to FIG. 3A and showing the bottle in a second orientation.
Figure 3C:
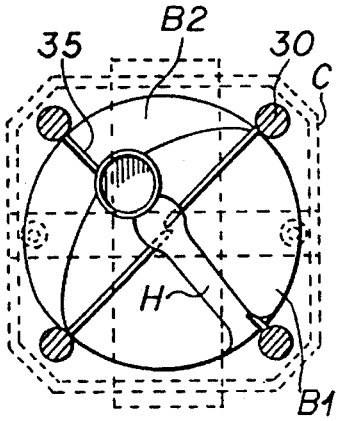
FIG. 3C is a schematic top plan view similar to FIGS. 3A and 3B and showing the bottle in a third orientation.

As illustrated in FIGS. 3A, 3B, and 3C, if the handle H is oriented so that the cap $B_2$ or neck $B_3$ does not block the full movement of three of the fingers 35, and with the cap $B_3$ blocking movement of the fourth finger 35, only three of the four fingers 35 will pass over the handle H and then spring back into their normal horizontal positions with their distal end portions beneath handle H, as illustrated in FIG. 3A. If, on the other hand, the handle H is in a position essentially bisecting the angle of two of the fingers 35, then the spout or cap $B_3$ will be disposed between the other two fingers and, under these conditions, all four of the converging fingers 35 will pass over the handle H and spring together below handle H and protrude into the opening $B_4$. This orientation of the bottle B and the fingers 35 is illustrated in 3B.

In FIG. 3C is illustrated an orientation of the bottle B in which the cap $B_3$ blocks one of the fingers 35 and the handle H is oriented so as to block the diametrically opposed finger 35. In this condition, only the remaining two fingers 35 will pass over the handle H and pivot together below handle H and in opening $B_4$. Thus, regardless of the circumferential orientation of handle H, once at least two of the fingers 35, which are in opposition to each other, pass over the handle H and spring back into their horizontal positions, as dictated by the nuts or stops 42 on the ends of rod 36, the bottle B is engaged and can then be lifted in a vertical direction by manipulation of belt 20 and transported laterally in any direction dictated by movement of the shaft 16.

When the shaft 16 positions the frame assembly 10 over the box C or receiving surface the belt 20 is extended so that the fingers 35 are again lowered in a vertical direction. Thus, the bottle B which has been carried by the fingers 35 is progressively lowered into a prescribed compartment in the box C. Upon reaching the appropriate depth, a cam (not shown) actuates the lever 53 so as to open valve 52, thereby feeding compressed air or other fluid into the cylinder 50 so as to cause the cylinder 50 to drive its piston downwardly for moving the control plate 45 in a downward direction toward the base plate 12. This action releases stops 42 and permits the springs 40 to urge the rods 36 downwardly until the nuts or stops 42 permit no further downward movement of the rods 40. As the plate 45 is depressed, this linkage permits the fingers 35 to pivot downwardly to release the handle H as the frame assembly 10 is lifted vertically, leaving the bottle H deposited in container C.

Since the guide rods 30 protrude below the fingers 35 and the pivot pins 32, they guide the apparatus 10 in its upward movement until the fingers 35 are clear of the bottle B. At that time the lever 53 is released, causing air pressure to pass through the other tube 51*a* to return the piston of cylinder 50 to its original position, moving control plate 45 upwardly to the position shown in FIG. 1. In such a position, the control rods 36 arrange the fingers 35 in their horizontal opposed relationship for an additional cycle for lifting and depositing another the bottle B.

While I have described the operation of a single unit of the apparatus for lifting and depositing bottles, one skilled in the art will understand that a plurality of such apparatuses can be joined together for lifting and depositing a plurality of bottles, simultaneously.

It will be obvious to those skilled in the art that many variations may be made in the embodiment here chosen for the purpose of illustrating the preferred embodiment of the invention, without departing from the scope thereof as defined by the appended claims.

I claim:

1. Apparatus for selectively engaging and disengaging a container having a handle protruding from it for transporting the container by its handle from one place to another, comprising:

(a) a movable frame;

(b) a plurality of fingers, each of said fingers having a proximal end and a distal end, said fingers being supported by their proximal end portions on said frame and protruding inwardly toward each other so that their distal ends terminate in a normal position adjacent to each other;

(c) means for moving said movable frame toward and away from said container when said container is in an initial position;

(d) means for manipulating said fingers to permit withdrawal of the distal ends of said fingers in an upwardly path with respect to said frame from each other for passing on opposite sides of said handle when said frame is moved downward toward said container and for enabling the distal ends of said fingers to move toward each other and to said normal position and between said handle and said container after said fingers have passed said handle;

(e) said means for moving said frame being adapted to move said frame away from said initial position of said container so that said container is carried by said fingers in said normal position with said fingers engaging said handle;

(f) said means for moving said frame being adapted to position said container on a receiving surface;

(g) said means for manipulating said fingers, being adapted for moving said distal ends of said fingers in a downward path and away from each other for releasing said handle; and (h) said means for moving said frame being adapted to move said frame away from said container while said distal ends of said fingers are moved downwardly and away from each other for thereby releasing said container on its receiving surface.

2. The structure defined in claim 1 wherein said fingers are pivotally mounted by their proximal ends to said frame and wherein said means for manipulating said fingers includes control rods engaging said fingers for releasably supporting said fingers from movement about their proximal end portions when said fingers are in their normal position.

3. The apparatus defined in claim 2 wherein said frame includes a base plate disposed above said fingers, said rods protruding from said base plate and said means for manipulating said fingers includes a control plate for simultaneously manipulating said rods.

4. The apparatus defined in claim 3 wherein said means for manipulating said fingers includes a fluid operated cylinder supporting said control plate for moving said control plate toward and away from said base plate for causing said rods to move to positions in which the fingers release said handle when said control plate is moved toward said base plate.

5. The apparatus defined in claim 1 wherein said means for manipulating said fingers includes a plurality of control rods, the lower ends of which are respectively connected to said fingers, and a control plate for simultaneously moving said control rods in a direction for causing the distal ends of said fingers to move away from each other set.

6. The apparatus defined in claim 1 wherein said means for manipulating said fingers includes a fluid operated cylinder and a linkage connected between said fluid operating cylinder and said fingers for supporting said fingers in their normal position when said fingers are supporting said container and for releasing said fingers to move downwardly to release said container in response to actuation of said cylinder.

7. The apparatus defined in claim 1 wherein said plurality of fingers includes four fingers pivotally mounted by their proximal ends to said frame, said fingers protruding toward each other so that the distal ends of all said fingers converge toward each other.

8. The apparatus defined in claim 7 wherein said means for manipulating said fingers include rods pivotally connected to intermediate portions of said fingers, said rods protruding upwardly, a control plate, actuator means for actuating said control plate, said rods protruding through said control plate, stop means on the ends of said rods above said base plate for limiting movement of said rods toward said fingers and springs for biasing said rods for movement in a direction toward said fingers so that said rods are urged toward said fingers by said springs when said control plate is actuated by said actuating means.

9. The apparatus defined in claim 1 wherein said frame includes a base and said means for manipulating said fingers includes control rods protruding downwardly from said base for engaging said fingers.

10. Apparatus for selectively lifting and depositing a bottle from a first supporting surface to a second supporting surface, the bottle having sides and a bottom at its lower portion and a handle connected to the upper portion of the bottle and by which the bottle may be lifted, the handle having a transversely extending portion accessible from above the bottle, comprising:

(a) a movable support frame for being disposed over said first supporting surface and said bottle, said support frame being movable from an upper position to a lower position;

(b) means for lowering and raising said support frame toward and away from the bottle;

(c) said support frame including guide means for engaging said sides of said bottle for aligning said support frame with the bottle as said support frame is lowered and as the bottle rests on said first supporting surface;

(d) a plurality of opposed handle engaging fingers having proximal ends and distal ends, said fingers being pivotally connected by their proximal ends to the frame, said fingers having normal positions in which the distal ends of said fingers protrude inwardly toward each other; and (e) control means for permitting said fingers to pivot upwardly for passing said fingers downwardly and around opposite portions of the transverse portion of said handle and then returning said fingers to their normal positions when said support frame is lowered over said bottle and maintaining said fingers in their normal positions for lifting said bottle when the frame is raised and for transporting said bottle and depositing it on a second supporting surface, said control means also permitting, after the bottle is deposited on said second surface and said fingers are in their normal position below the transversely extending portion of the bottle handle, said fingers to pivot downwardly for releasing said transverse portion from said frame as said frame is raised and moved away from said container on said second surface.

11. The apparatus of claim 10, wherein said movable support frame comprises:

(a) a support strap;

(b) a generally horizontal base plate carried by said support strap;

(c) said control means including a generally horizontal control plate movably supported by said frame above said base plate; and (d) actuator means on said support frame for moving said control plate toward and away from said base plate.

12. The apparatus of claim 11, wherein said movable support frame further comprises:

at least two spaced guide pins mounted on said base plate and extending upward and passing through said control plate for guiding said control plate; and wherein said actuator means moves said control plate toward and, away from said base plate guided by said guide pins.

13. The apparatus of claim 12, wherein said control means is a fluid actuated cylinder and piston, and including a valve for controlling said cylinder and piston.

14. The apparatus of claim 13, wherein said cylinder is a pneumatic cylinder and said fluid is air.

15. The apparatus of claim 11, wherein said frame has a base plate:

a control plate above said base plate;

control rods for said fingers, each of said control rods having a proximal end and a distal end, said proximal end of each of said control rods being pivotally connected to one of said fingers, intermediate the ends of that finger, said control rods extending upwardly through said base plate and said control means; and springs mounted on said control rods for yieldably urging said control rods toward said fingers.

16. The apparatus of claim 15, wherein said springs abut said base plate and including stops on the upper end portions of said rods for abutting said control plate.

17. The apparatus of claim 16 wherein control rods are provided with external threads and said stop threadedly engage the threads of said control rods above said control plate.

18. The apparatus of claim 10, wherein said means for lowering and raising said support frame comprises:

a telescoping shaft carrying said support frame;

a lifting pulley disposed on said telescoping shaft; and a lifting belt engaging said lifting pulley for moving said frame toward and away from said bottle.

19. The apparatus of claim 10 wherein said guide means for aligning said support frame and bottle comprises:

a plurality of guide rods mounted upon said movable frame, each of said guide rods extends downwardly from said movable support frame for engaging a side portion of said bottle, and each of said guide rods having an edge for guiding said movable support frame into alignment with said bottle.

20. The apparatus of claim 19, wherein said frame has a vertical axis and said fingers include four circumferentially equally spaced rigid fingers pivotally mounted by their proximal ends on said movable support frame and normally protruding generally radially toward said axis so that their distal ends terminate adjacent to each other.

21. The apparatus of claim 10, wherein said handle engaging fingers are provided with openings at their proximal ends and including pins passing through said openings and into said guide means for pivotally connecting said fingers to said guide means.

22. The apparatus of claim 10, wherein said frame has a vertical axis and said handle engaging fingers, include four circumferentially spaced fingers connected to said frame and converging toward said axis.

23. The apparatus of claim 22, wherein said fingers are approximately 90 degrees from each other, and lie in a generally common horizontal plane when said fingers are in their normal positions.

24. A method for engaging and transporting a bottle from a first supporting surface to a second supporting surface, said bottle having a bottom and a handle connected to the upper portion of the bottle and by which the bottle may be lifted, the handle having a transversely extending portion accessible from above the bottle, comprising the steps of:

(a) positioning said bottle on said first surface;

(b) pivotally holding an elongated rigid yieldable handle engaging finger by its proximal ends, said finger having a distal end portion;

(c) moving said finger sidewise downwardly so that said distal end portion rides along the surface of said handle and pivots over and around the transversely extending portion of said handle and terminates below said handle;

(d) holding said finger in a generally horizontal normal position with a portion of said finger disposed between said handle and said bottle;

(e) raising said finger way from said first surface while maintaining said finger in its normal position for causing said finger to lift said bottle by its handle away from said first surface;

(f) lowering said finger and the bottle toward a second platform;

(g) placing the bottle upon said second surface; and (h) raising said finger away from said second surface while permitting said finger to pivot downwardly so that its distal end passes along the surface of said handle and passes around said bottle to release said bottle.

25. The method of claim 24, wherein step (e) further comprises lowering the bottle into a packing box forming said second surface.

26. Method of transferring a container having a handle protruding therefrom, from a first supporting surface to a second supporting surface, said handle having a transverse dimension, comprising:

(a) disposing said container on said first supporting surface;

(b) yieldably supporting a plurality of fingers in normal positions converging toward each other so that the end portions of said fingers terminate adjacent to each other by a distance less than the transverse dimension of said handle;

(c) simultaneously moving said fingers toward said container and said handle so that the ends of at least some of said fingers yieldably pass on opposite sides of said handle and return to their normal positions with said ends being disposed between said handle and said container;

(d) thereafter simultaneously moving said fingers away from said supporting surface while arresting movement of said some of said fingers with respect to each other such that some of said fingers support and move said container by its handle;

(e) simultaneously moving said fingers toward said second surface while arresting their relative movement of said some of said fingers with respect to each other so that said fingers deposit said container on said second surface; and (f) moving said fingers downwardly and away from each other and away from said second surface so that the ends of said some of said fingers pass on opposite sides of said handle and away from said container for releasing said container on said second surface.

27. The method defined in claim 26 wherein said container is a bottle having an off-center neck and its handle is disposed adjacent to said neck.

28. The method defined in claim 27 wherein said neck arrests other of said fingers so that the arrested fingers do not support the bottle, due to the orientation of said bottle on said first surface.

29. The method defined in claim 27, said handle arrests other of said fingers from engaging said handle for lifting and transporting said bottle.

30. The method defined in claim 26 including positioning a second container on said first surface in a different orientation of its handle from the orientation of the first mentioned container and repeating steps (b) through (f) whereby the fingers which pass on opposite sides of said handle of said second container are different from the fingers which passed around the handle of the first mentioned container.

31. A method of lifting and transporting a bottle having a body, an off-center neck and a laterally extending handle extending from said neck to said bottle comprising:

(a) pivotally supporting a plurality of at least three circumferentially spaced elongated fingers, each having a distal end and a proximal end, by their proximal ends so that the fingers protrude inwardly in prescribed positions toward each other;

(b) holding said fingers over said bottle; so that said handle is randomly positioned beneath said plurality of at least three circumferentially spaced, elongated fingers;

(c) moving the fingers by their proximal ends downwardly while the fingers remain extended toward each other so that at least two of the distal ends of two of said fingers engage said handle and are moved upwardly in arcuate paths as their proximal ends are moved downwardly;

(d) continuing the downward movement of said proximal ends until the distal ends of said at least two of said fingers pass on opposite sides of said handle and then pivot to their prescribed positions; and (e) moving said fingers upwardly while arresting pivotal movement of said fingers in a downward direction for transporting said bottle by its handle.

32. Apparatus for lifting and transporting a bottle, having an upstanding off-center neck and a sidewise extending handle on the upper side of said bottle adjacent to said neck, from a position in which the bottle is supported by its bottom to a second position comprising;

(a) a frame;

(b) a support for supporting, lowering and lifting said frame from a position over said bottle to a lowered position and then to a raised position;

(c) guides on said frame for aligning said frame with said bottle as said frame is lowered;

(d) a plurality of at least three circumferentially spaced lifting fingers pivotally carried by their proximal ends by said frame, said fingers protruding inwardly toward each other;

(e) said support being adapted to lower said frame from its raised position over the top of said bottle to said lowered position;

(f) means for temporarily arresting said fingers so that said fingers may readily pivot upwardly and outwardly but are temporarily arrested in their downwardly and outwardly pivoting movement;

(g) said guides orienting said frame with respect to said bottle when said frame is lowered so that two of the three fingers pass around opposite sides of said handle as said frame is lowered and then are returned to their positions extending toward each other with the distal ends of said two fingers being below said handle, as the other of said fingers is held out of engagement with said handle by said neck; and (h) said means for temporarily arresting said fingers, arresting downward movement of said two fingers so that said two fingers lift said bottle by its handle for transporting said bottle with said two fingers and as said third finger is held out of engagement with said handle by said neck.

33. The apparatus defined in claim 32 including a fourth finger pivotally carried by said frame, said fourth finger and said three fingers being equally circumferentially spaced from each other, the orientation of said three fingers and said fourth finger being such that when said frame is lowered and regardless of the orientation of said frame with respect to said bottle, at least one of said fingers or said finger is held out of engagement from supporting of said bottle by its handle.

* * * * *